US011547160B2

(12) United States Patent
Randall et al.

(10) Patent No.: US 11,547,160 B2
(45) Date of Patent: Jan. 10, 2023

(54) GOWN WITH SELECTIVELY OPENABLE SLEEVE

(71) Applicant: Medline Industries, LP, Northfield, IL (US)

(72) Inventors: Rachel Randall, Des Plaines, IL (US); Teri Burke, Wauconda, IL (US)

(73) Assignee: Medline Industries, LP, Northfield, IL (US)

( * ) Notice: Subject to any disclaimer, the term of this patent is extended or adjusted under 35 U.S.C. 154(b) by 412 days.

(21) Appl. No.: 16/185,081

(22) Filed: Nov. 9, 2018

(65) Prior Publication Data

US 2020/0121006 A1 Apr. 23, 2020

Related U.S. Application Data

(60) Provisional application No. 62/749,501, filed on Oct. 23, 2018.

(51) Int. Cl.

| | |
|---|---|
| ***A41D 13/12*** | (2006.01) |
| ***A41D 27/10*** | (2006.01) |
| ***A41D 27/24*** | (2006.01) |

(52) U.S. Cl.

CPC ..... *A41D 13/1245* (2013.01); *A41D 27/10* (2013.01); *A41D 27/24* (2013.01); *A41D 2300/324* (2013.01); *A41D 2400/52* (2013.01)

(58) Field of Classification Search

CPC ..... A41D 13/1245; A41D 13/00; A41D 13/1272; A41D 27/24; A41D 27/10;

(Continued)

(56) References Cited

U.S. PATENT DOCUMENTS 2,701,364 A * 2/1955 Palm ..... A41D 13/1236 2/114

3,276,036 A 10/1966 Carter et al.

(Continued)

FOREIGN PATENT DOCUMENTS

CN 203860512 8/2014
CN 205567921 9/2016

(Continued)

OTHER PUBLICATIONS

"Linear." Dictionary.com, Dictionary.com, Dec. 4, 2017, www.dictionary.com/browse/linear?s=t. (Year: 2017).*

(Continued)

*Primary Examiner* — Khoa D Huynh
*Assistant Examiner* — Grace Huang
(74) *Attorney, Agent, or Firm* — Philip H. Burrus, IV

(57) ABSTRACT

A garment (300) includes a body-covering portion (301). A sleeve (100) is attached to the body-covering portion at a seam (310) and extends to a terminal edge (102) defining a first linear portion (104), a second linear portion (105), and a curved portion (106) spanning the first linear portion and the second linear portion. A first fastener (107) is coupled to the first linear portion on an interior side (201) of the terminal edge, while a second fastener (108) is coupled to the second linear portion on an exterior side (101) of the terminal edge. A third fastener (212) is coupled to the seam on an exterior side of the seam, while a fourth fastener (211) coupled to the seam on an interior side of the seam.

8 Claims, 8 Drawing Sheets

(58) Field of Classification Search
CPC ..... A41D 2300/324; A41D 2400/52; A41B 13/06; A41B 17/00
USPC ..... 2/114, 104, 105, 106, 127, 128, 133, 2/69.5, 75, 80, 269, 270
See application file for complete search history.

(56) References Cited

U.S. PATENT DOCUMENTS 3,721,998 A 3/1973 Meyers
3,748,659 A 7/1973 Meyers
D233,634 S 11/1974 Snider
D236,293 S 8/1975 Banks
4,570,268 A * 2/1986 Freeman ..... A41D 13/1236 2/114
4,612,673 A * 9/1986 Underhill ..... A41D 13/1236 2/114
4,737,995 A * 4/1988 Wiley ..... A41D 13/1236 2/114
4,920,578 A * 5/1990 Janzen ..... A41D 13/1236 2/114
5,062,160 A 11/1991 Dillon, Jr.
5,093,934 A 3/1992 Dillon, Jr.
5,184,351 A * 2/1993 Benstock ..... A41D 13/1236 2/105
5,222,258 A 6/1993 Mucchi et al.
D336,968 S 7/1993 Russano
D374,970 S 10/1996 Jagger
D378,157 S 2/1997 Jagger
5,799,330 A 9/1998 O'Donoghue-Kitt
D419,748 S 2/2000 Sartori
6,115,840 A * 9/2000 Hastings ..... A41D 13/1245 2/114
6,484,321 B1 * 11/2002 Shamam ..... A41D 13/1245 2/114
7,305,716 B1 * 12/2007 Richards ..... A41D 13/1245 2/114
D563,627 S 3/2008 Warren
D565,279 S 4/2008 Ferrell
D574,126 S 8/2008 McCray
D584,483 S 1/2009 Glynn
D612,126 S 3/2010 Milgrom
7,694,350 B2 * 4/2010 Hodges ..... A41D 1/215 2/114
D635,739 S 4/2011 Toms et al.
8,069,497 B2 * 12/2011 Sheward ..... A41D 13/1245 2/114
D657,530 S 4/2012 Farris et al.
8,375,466 B2 * 2/2013 Tasezen ..... A41D 13/1236 2/69
8,821,461 B2 * 9/2014 Kovensky ..... A41D 13/1281 2/104
D721,869 S 2/2015 Bernier
8,990,966 B2 3/2015 Furstenberg et al.
D727,595 S 4/2015 Lawson et al.
D741,569 S 10/2015 Fredrickson
9,320,308 B2 4/2016 Forbes et al.
D760,474 S 7/2016 Alonzo
D767,252 S 9/2016 Antons
D778,038 S 2/2017 Lomax
D796,781 S 9/2017 Calucci
D802,884 S 11/2017 Bennett
9,894,945 B2 * 2/2018 Fredrickson ..... A41D 13/1236
D811,692 S 3/2018 Calucci et al.
D829,411 S 10/2018 Brewerton et al.
10,165,809 B2 * 1/2019 Tong ..... A41D 13/1245
D855,287 S 8/2019 Smith Corby
D857,336 S 8/2019 Calucci et al.
D878,008 S 3/2020 Mosley
D889,075 S 7/2020 Burke et al.
10,701,996 B2 * 7/2020 Griffin ..... A41D 27/24
10,709,182 B1 * 7/2020 Healy ..... A41D 13/1263
D894,534 S 9/2020 Pettigrew
11,122,844 B1 * 9/2021 Coban ..... A41D 13/129
2003/0126668 A1 7/2003 Scroggins
2007/0240248 A1 * 10/2007 Hodges ..... A41D 1/215 2/104
2008/0000006 A1 * 1/2008 Ochoa ..... A41D 13/1236 2/114
2009/0100569 A1 * 4/2009 Butler ..... A41F 1/00 2/114
2010/0017933 A1 * 1/2010 Taylor-Barry ..... A41D 13/1254 2/83
2010/0050315 A1 * 3/2010 Christou-Kelly ..... A41D 13/1263 2/114
2013/0131617 A1 * 5/2013 Kovensky ..... A41D 13/1281 604/327
2014/0352025 A1 * 12/2014 Adler ..... A41D 13/1245 2/69
2016/0374422 A1 * 12/2016 Denny ..... A42B 1/205 2/410
2017/0273372 A1 * 9/2017 Deng ..... A41D 13/1236
2017/0325523 A1 * 11/2017 Stewart ..... A41D 13/129
2018/0014586 A1 1/2018 Bok
2019/0166930 A1 * 6/2019 Stewart ..... A41D 13/129
2020/0154801 A1 * 5/2020 Burke ..... A41D 13/1245

FOREIGN PATENT DOCUMENTS

DE 202012004109 U1 * 8/2012 ..... A41D 27/10
FR 369081 A * 12/1906 ..... A41D 3/08

OTHER PUBLICATIONS

"Line." Dictionary.com, Dictionary.com, Sep. 23, 2017, www.dictionary.com/browse/line?s=t. (Year: 2017).*
Rudzinski, Kevin K. , "Notice of Allowance", U.S. Appl. No. 29/670,918; Filed Nov. 20, 2018; dated Oct. 7, 2020.
"Patient Gown, Butterfly, Tieside, Tranquility by BH Medwear", Posted to amazon.com; Available Date Sep. 23, 2009, site visited Jan. 29, 2021; Available at https://www.amazon.com/PATIENT-GOWN-BUTTERFLY-TIESIDE-TRANQUILITY/dp/B002Q66IL6/ref=cm_cr_arp_d_product_top?is=UTF8.
Luthra, Shefali , "In Pursuit of Patient Satisfaction, Hospitals Update the Hated Hospital Gown", Published Mar. 31, 2015 at khn.org; Viewed online at https://khn.org/news/in-pursuit-of-patient-satisfaction-hospitals-update-the-hated-hospital-gown/.
Rudzinski, Kevin Keith , "Notice of Allowance", U.S. Appl. No. 29/670,918, filed Nov. 20, 2018; dated Feb. 3, 2021.

* cited by examiner

GOWN WITH SELECTIVELY OPENABLE SLEEVE

CROSS REFERENCE TO PRIOR APPLICATIONS

This application claims priority and benefit under 35 U.S.C. § 119(e) from U.S. Provisional Application No. 62/749,501, filed Oct. 23, 2018, which is incorporated by reference for all purposes.

BACKGROUND

Technical Field

This disclosure relates generally to gowns, and more particularly to gowns with sleeves.

Background Art

Patients frequently wear gowns during medical procedures. The gowns allow medical professionals to access parts of the body under treatment, while at the same time preserving patient dignity by keeping the rest of the patient covered. It would be advantageous to have an improved gown that allowed easier access to parts of the body under treatment.

Figure 1:
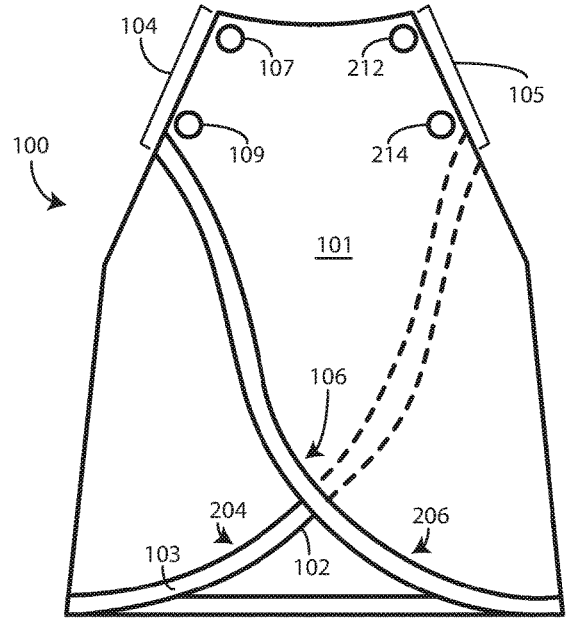
FIG. 1 illustrates an elevation view of one explanatory selectively openable sleeve for a gown in a closed configuration in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF EMBODIMENTS OF THE DISCLOSURE

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. The terms "substantially" and "about" are used to refer to dimensions, orientations, or alignments inclusive of manufacturing tolerances. Thus, a "substantially orthogonal" angle with a manufacturing tolerance of plus or minus two degrees would include all angles between 88 and 92, inclusive. Also, reference designators shown herein in parenthesis indicate components shown in a figure other than the one in discussion. For example, talking about a device (10) while discussing figure A would refer to an element, 10, shown in figure other than figure A.

Embodiments of the present disclosure provide a gown that includes a body-covering portion and one or more sleeves attached to the body-covering portion. In one or more embodiments, at least one sleeve is attached to the body-covering portion at a seam. The sleeve extends from the seam to a terminal edge. In one embodiment, the terminal edge defines a first linear portion, a second linear portion, and a curved portion that spans the first linear portion and the second linear portion.

Fasteners, such as snaps, can be coupled along the terminal edge of the sleeve. For example, a first fastener can be coupled to the first linear portion on an exterior side of the sleeve, while a second fastener can be coupled to the second linear portion on an interior side of the sleeve.

In one or more embodiments, complementary fasteners can then be attached to the body-covering portion along the seam. For instance, a third fastener can be coupled to the body-covering portion along the seam on an interior side of the seam, while a fourth fastener is coupled to the body-covering portion along the seam on an exterior side of the seam.

In one or more embodiments, portions of the sleeve, and the terminal edge overlap to allow the first fastener to couple to the first fastener. Similarly, the second fastener can couple to the fourth fastener. This closes the sleeve so that a patient's arm, when wearing the gown, will be covered.

However, when a medical services provider needs to access the arm, the sleeve advantageously is openable. To open the sleeve, in one embodiment the first fastener is detached from the third fastener, while the second fastener is released from the fourth fastener. This allows the overlapping portions of the sleeve to be unfolded, thereby exposing the entire shoulder and arm of the wearer from neck to wrist.

In one or more embodiments, two fasteners are included along the first linear portion and second linear portion of the sleeve. Correspondingly, two fasteners can be coupled to the body-covering portion along the seam. Where this occurs, the first linear portion of the sleeve can be coupled to the body-covering portion along the seam in two locations instead of one. Similarly, the second linear portion of the sleeve can be coupled to the body-covering portion at two locations as well. While two fasteners are disposed along the first linear portion and the second linear portion of the sleeve, respectively, in an illustrative embodiment described below, it will be obvious to those of ordinary skill in the art having the benefit of this disclosure that embodiments could include more, or fewer, fasteners as well.

Figure 5:
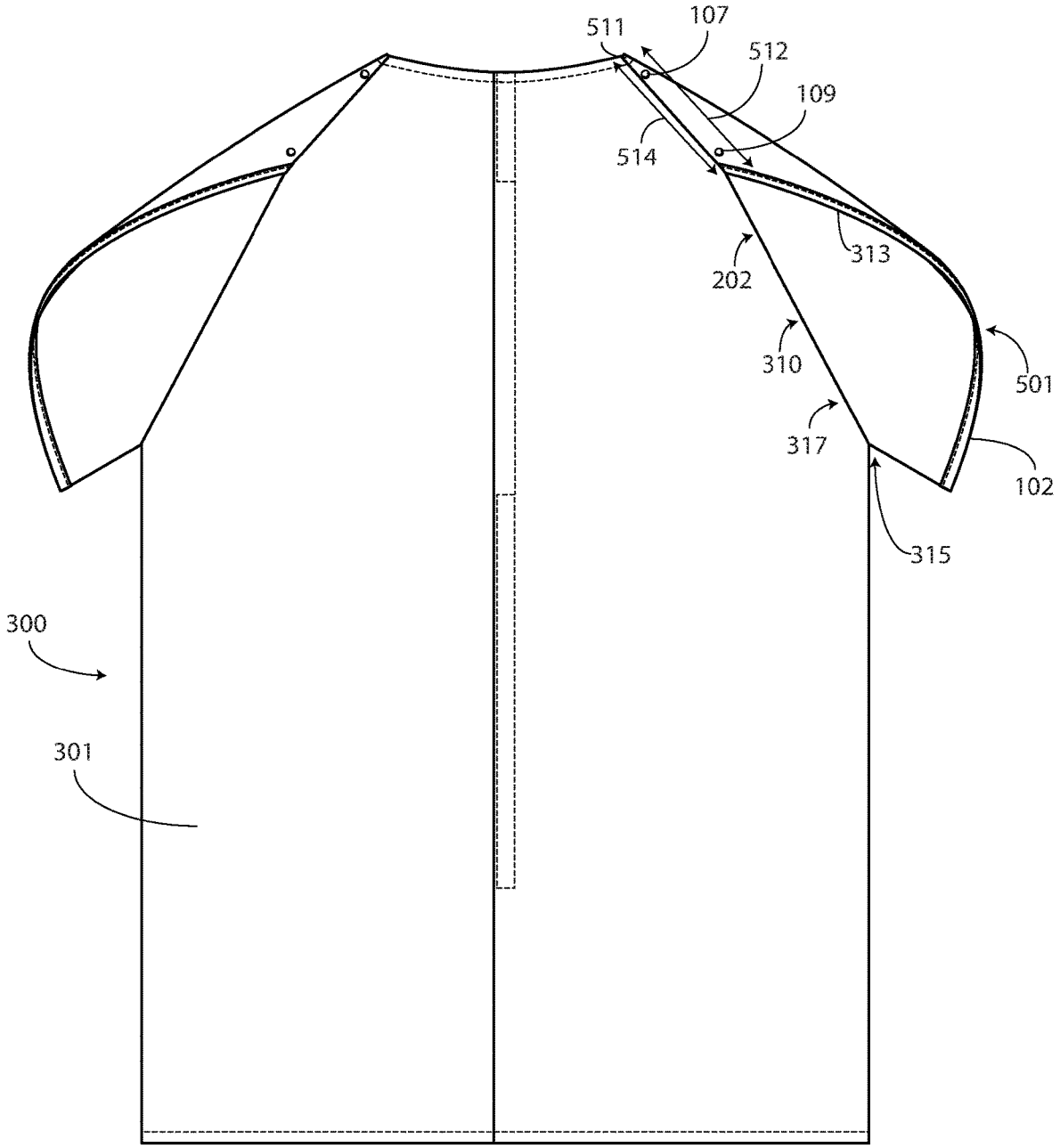
FIG. 5 illustrates a rear view of one explanatory gown configured in accordance with one or more embodiments of the disclosure.
Figure 6:
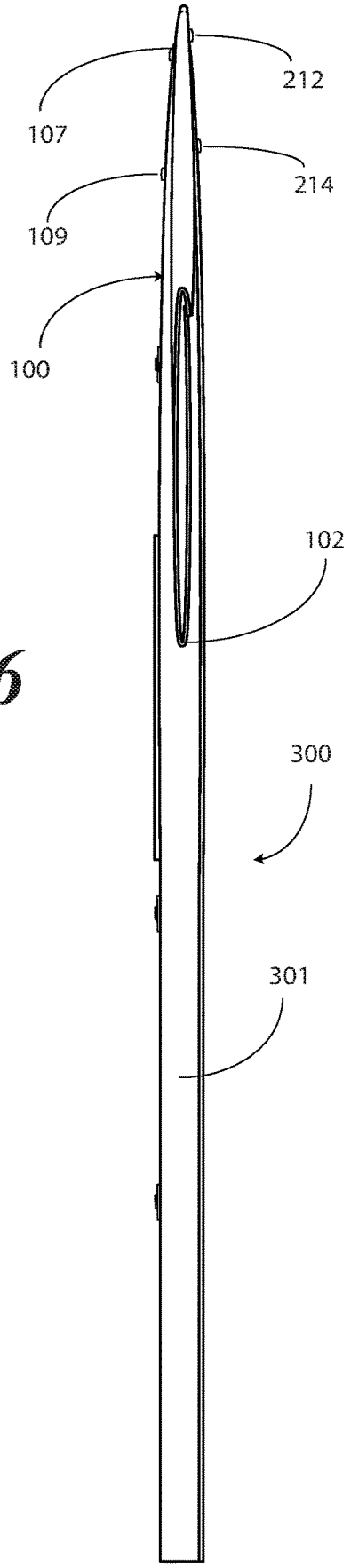
FIG. 6 illustrates a side view of one explanatory gown configured in accordance with one or more embodiments of the disclosure.

In one or more embodiments where the sleeve includes a curved portion spanning the first linear portion and second linear portion of the terminal edge of the sleeve, when the sleeve portions are overlapped to close the sleeve this curved portion overlaps itself to give the appearance of a convex down inverted chevron shape. As is understood by those of ordinary skill in the art, a "chevron" is a V-shaped mark that is often inverted. Where the chevron is "convex down," rather than including straight sides it includes curved sides that define curvilinear segments that are convex down and concave up. This will be shown in more detail below with reference to FIG. 5.

Advantageously, this convex down inverted chevron shape allows partial access to a patient's arm even when the fasteners are all connected to close the sleeve. Thus, in addition to providing full access when the fasteners are decoupled or released from each other, embodiments of the disclosure also provide partial access to a patient's arm without opening the sleeve.

Figure 2:
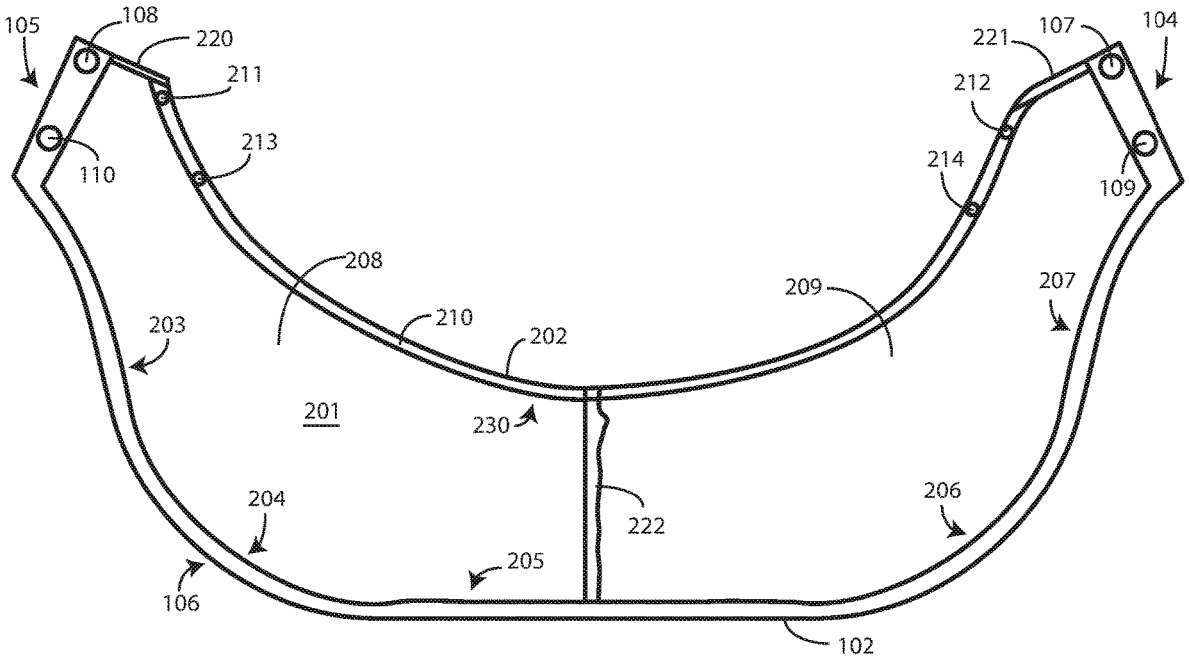
FIG. 2 illustrates an elevation view of one explanatory selectively openable sleeve for a gown in an open configuration in accordance with one or more embodiments of the disclosure.
Figure 3:
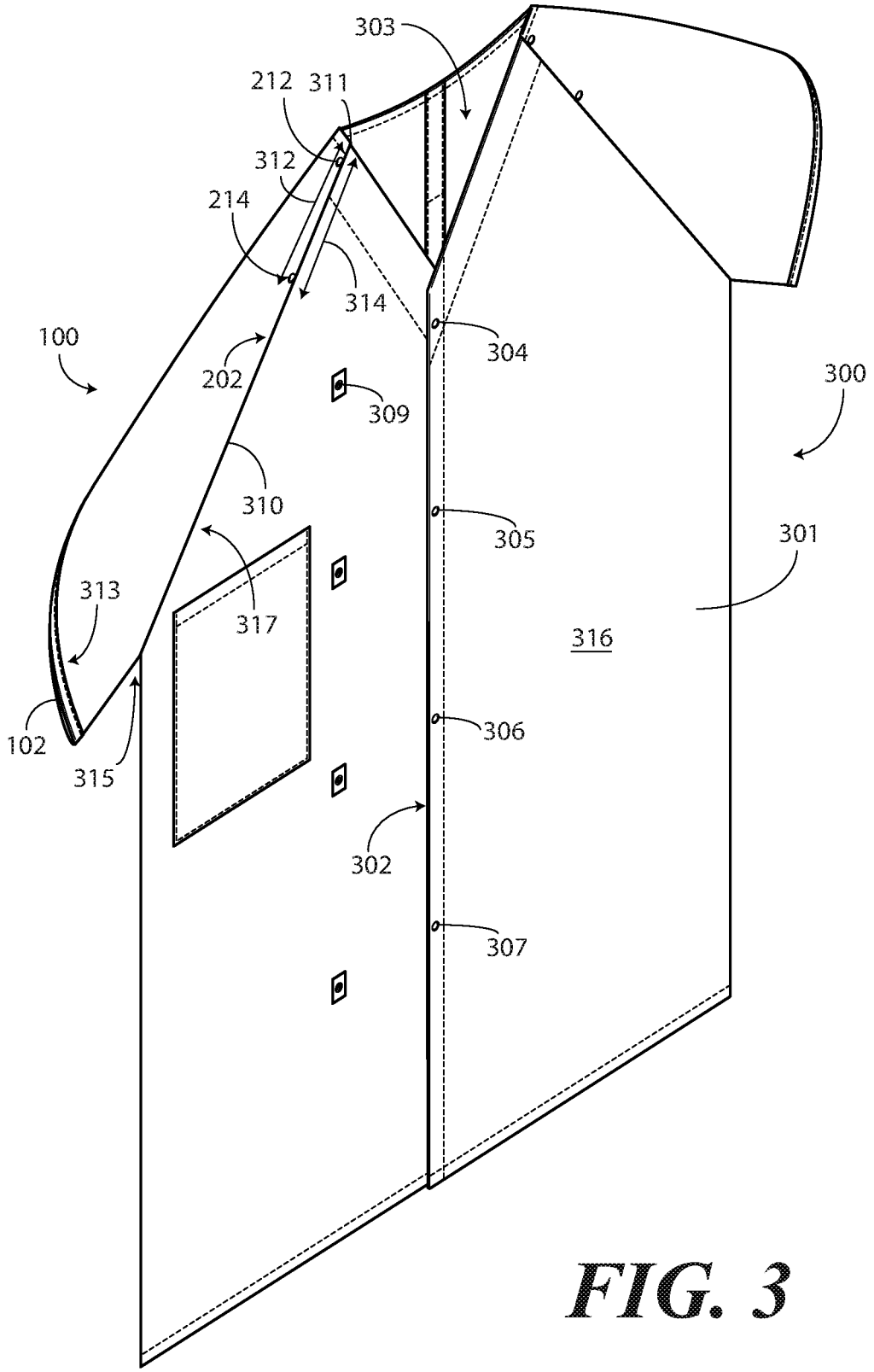
FIG. 3 illustrates a perspective view of one explanatory gown configured in accordance with one or more embodiments of the disclosure.
Figure 4:
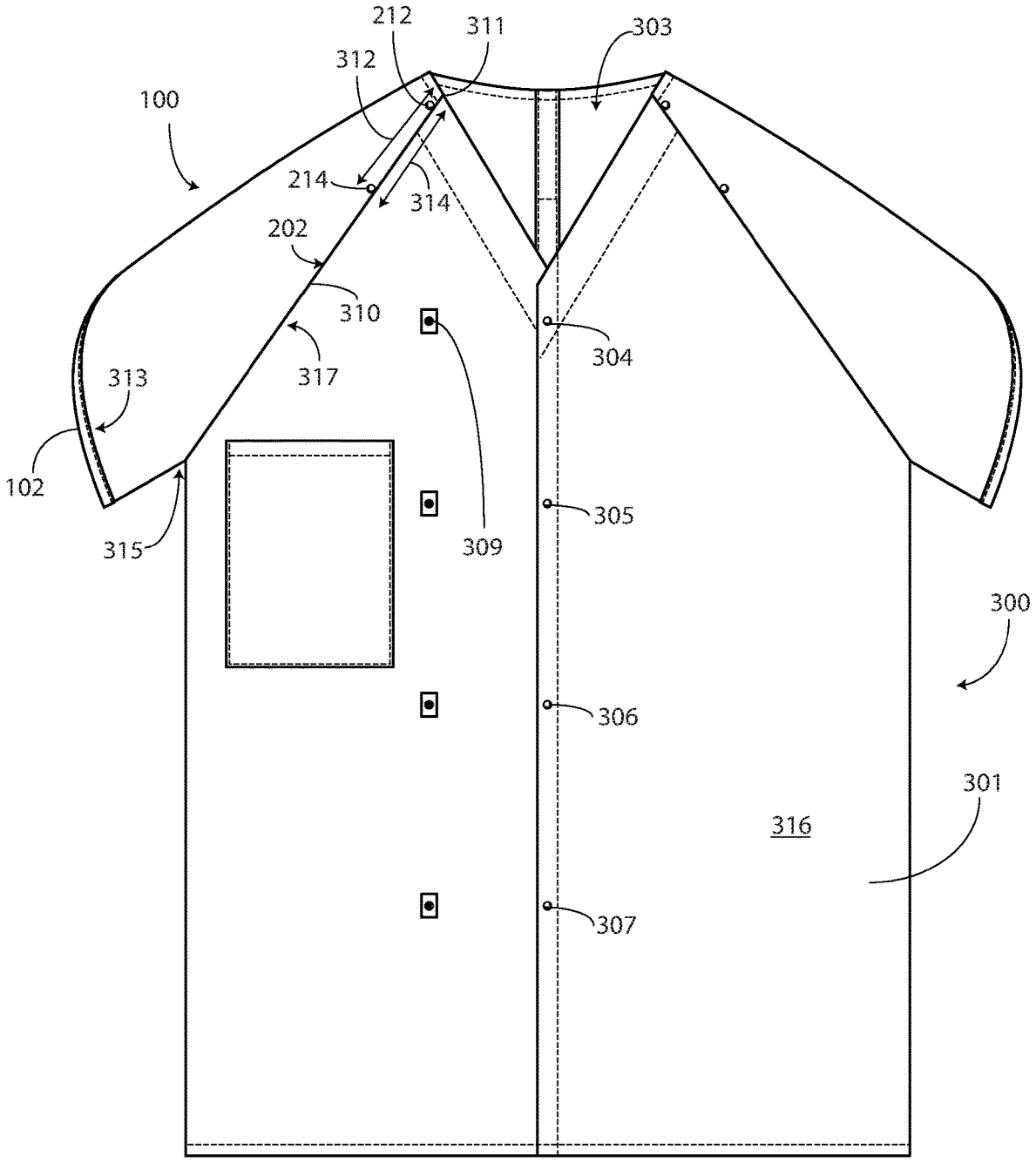
FIG. 4 illustrates a front view of one explanatory gown configured in accordance with one or more embodiments of the disclosure.

Turning now to FIGS. 1 and 2, illustrated therein is one embodiment of a sleeve 100 in accordance with one or more embodiments of the disclosure. In one or more embodiments, the sleeve 100 is selectively openable to permit access to a person's arm and/or shoulder when positioned within the sleeve. In FIG. 1, the sleeve 100 is shown in a closed configuration, with an exterior surface 101 facing outward. In FIG. 2, the sleeve 100 is shown in an open configuration, with an interior surface 201 facing outward.

The sleeve 100 can be manufactured from a variety of materials. In one embodiment, the sleeve 100 is manufactured from a washable fabric, such as cotton, polyester, or a cotton polyester blend. In another embodiment, the sleeve 100 is manufactured from non-woven fabric so as to be disposable. In one or more embodiments, the sleeve 100 includes a water resistant lining that prevents the passage of fluids therethrough. Antimicrobial or antibacterial coatings or treatments may be applied to the material forming the sleeve 100 as well.

In one or more embodiments the sleeve 100 includes a proximal edge 202 and a terminal edge 102. In one or more embodiments, two head insertion edges 220,221 separate the proximal edge 202 and the terminal edge 102.

In this illustrative embodiment, the terminal edge 102 comprises a hem 103. In one or more embodiments, the hem 103 can be color-coded. Since the sleeve 100 is selectively openable, embodiments of the disclosure contemplate that the sleeve 100 may be in an open configuration when being laundered. Accordingly, it may not be immediately obvious how to close the sleeve 100 when retrieving it from the laundering cycle. As such, a color-coded hem may assist the laundering professional in more quickly closing the sleeve 100. For example, where the sleeve 100 is configured as a right-arm sleeve, the hem 103 may be color-coded yellow. By contrast, where the sleeve 100 is configured as a left-arm sleeve, the hem 103 may be color-coded blue, and so forth. These colors are illustrative only, as numerous others will be obvious to those of ordinary skill in the art having the benefit of this disclosure.

The terminal edge 102 includes a first linear portion 104, a second linear portion 105, and a curved portion 106. In one or more embodiments, the curved portion 106 spans the first linear portion 104 and the second linear portion 105. As used herein, "span" means to extend from side to side of something. Thus, by spanning the first linear portion 104 and the second linear portion 105, the curved portion 106 connects an end of the first linear portion 104 to an end of the second linear portion 105.

In this illustrative embodiment, the curved portion 106 comprises a first convex up contour 203, a first convex down contour 204, a second convex down contour 206, and a second convex up contour 207. A substantially straight length 205 spans the first convex down contour 205 and the second convex down contour 206.

Like the terminal edge 102, in this illustrative embodiment the proximal edge 202 also includes a curved section 230. In one or more embodiments, the curved section 230 spans the two head insertion edges 220,221 separate the proximal edge 202 and the terminal edge 102 as shown in FIG. 2.

One or more fasteners are connected to the sleeve 100. In one or more embodiments, at least a first fastener 107 is coupled to the first linear portion 104. In one or more embodiments, at least a second fastener 108 is coupled to the second linear portion 105. The fasteners can take various forms. In one or more embodiments, the first fastener 107 and the second fastener 108 each comprise snaps. However, it will be obvious to those of ordinary skill in the art having the benefit of this disclosure that other fasteners, such as hook and loop fasteners, buttons, strings, ties, zippers, or hooks can be substituted for the snaps as well. The snaps can be color coded, i.e., colored so as to be visibly distinct from other snaps disposed along the sleeve 100, so as to assist a wearer or health care services provider in determining which snaps connect to which other snaps.

In one or more embodiments, each of the first fastener 107 and the second fastener 108 comprises a snap fastener. The snap fasteners can be metal or plastic. A first snap fastener is placed on the first linear portion 104, while another snap fastener is placed on the second linear portion 105. In one embodiment, the first fastener 107 comprises a female or "socket" snap fastener, while the second fastener 108 comprises a male or "post" snap fastener. Post fasteners can be coupled to socket fasteners by placing the post into the socket and pressing the second fastener's post into the first fastener's socket.

In this illustrative embodiment, the first fastener 107 is coupled to the sleeve 100 such that its female socket is exposed along the first linear portion 104 on an interior side 201 of the sleeve 100. This means that the coupling component, which is the snap socket in this illustration, is exposed along the interior side 201 of the first linear portion 104. This can occur even when the fastener itself passes through the first linear portion 104. For example, a load bearing surface of the first fastener 107, which can be a dome or flat surface where the first fastener 107 comprises a female snap, can be exposed along the exterior surface 101 of the first linear portion 104, while the socket is exposed along the interior surface 201 of the first linear portion 104 when the first fastener 107 is "coupled" on the interior side 201 of the sleeve 100 or along or adjacent to the first linear portion 104 of the sleeve 100.

Similarly, in this illustrative embodiment the second fastener 108 is coupled to the sleeve along the second linear portion 105 on an exterior side 101 of the sleeve 100. This means that the coupling component, which is the snap post in this illustration, is exposed along the exterior side 101 of the second linear portion 105. As before, this can occur even when the fastener itself passes through the second linear portion 105. For example, a load bearing surface of the second fastener 108, which can be a flat surface where the second fastener 108 comprises a male snap, can be exposed along the interior surface 201 of the second linear portion 105, while the post is exposed along the exterior surface 101 of the second linear portion 105 such that it extends distally away from the exterior surface 101 when the second fastener 108 is "coupled" on the exterior side 101 of the sleeve 100 or along or adjacent to the second linear portion 105 of the sleeve 100.

In this illustrative embodiment, a third snap fastener is placed on the first linear portion 104, while a fourth snap fastener is placed on the second linear portion 105. In one embodiment, the third fastener 109 comprises another female or "socket" snap fastener, while the fourth fastener 110 comprises another male or "post" snap fastener. While two fasteners are disposed along the first linear portion 104 and the second linear portion 105 of the sleeve 100, respectively, in this illustrative embodiment, it will be obvious to those of ordinary skill in the art having the benefit of this disclosure that embodiments could include more, or fewer, fasteners as well.

In one or more embodiments, as shown in FIG. 2, the sleeve 100 comprises a first sleeve layer portion 208 and a second sleeve layer portion 209. In this illustrative embodiment, the first sleeve layer portion 208 and the second sleeve layer portion 209 are coupled together at another seam 222. Here, the other seam 222 is oriented orthogonally with the hem 103. In other embodiments, such as that shown in FIG. 1, the sleeve 100 will comprise a single, continuous sleeve layer portion. Of course, the sleeve 100 could be divided into more than the two sleeve layer portions shown in FIG. 2 as well.

As best seen in FIG. 1, when the sleeve 100 is in the closed position, the curved portion 106 overlaps itself. In this illustrative embodiment, the second convex down contour 206 overlaps the first convex down contour 204. This allows the sleeve 100 to function as an intravenous or "IV" sleeve, in that the first convex down contour 204 and the second convex down contour 206 can be separated to provide medical services personnel partial access to a patient's arm through which intravenous medical apparatuses may pass.

In one or more embodiments, the sleeve 100 is configured to couple to the body-covering portion of a gown or other garment, as will be described in more detail below with reference to FIGS. 3-8. In one or more embodiments, the sleeve 100 attaches to the body-covering portion at a seam 210 where the proximal edge 202 is sewn to the body-covering portion.

In one or more embodiments, additional fasteners are coupled along the seam 210. For example, at least a fifth fastener 211 can be coupled to the seam 210 on an exterior side of the seam 210, while at least a sixth fastener 212 can be coupled to the seam 210 on an interior side of the seam 210 as shown in FIG. 2. In this illustrative embodiment, at least a seventh fastener 213 can be coupled to the seam 210 on an exterior side of the seam 210, while at least an eighth fastener 214 can be coupled to the seam 210 on an interior side of the seam 210.

The sleeve 100 is shown in an open configuration in FIG. 2. To transform the sleeve 100 to the closed configuration of FIG. 1, one folds the first sleeve layer portion 208 to the right (as shown in FIG. 2). One then couples the second fastener 108 to the sixth fastener 212 and the fourth fastener 110 to the eighth fastener 214.

One then folds the second sleeve layer portion 209 atop the first sleeve layer portion 208, which is to the left as shown in FIG. 2. One can then couple the first fastener 107 to the fifth fastener 211, while coupling the third fastener 109 to the seventh fastener 213. The resulting sleeve 100 is in a closed configuration, as shown in FIG. 1. To open the sleeve 100, one reverses this process.

Turning now to FIGS. 3-8, illustrated therein is one explanatory garment 300 comprising a sleeve 100 configured in accordance with one or more embodiments of the disclosure. In the illustrative embodiment, the garment 300 comprises a medical gown. However, the garment 300 could be configured for applications other than that of a medical gown as well.

In one or more embodiments, a body-covering portion 301 is configured to wrap about the torso of a wearer. In one embodiment, the garment 300 is manufactured from a washable fabric, such as cotton, polyester, or a cotton polyester blend. In another embodiment, the garment 300 is manufactured from non-woven fabric so as to be disposable. In one or more embodiments, the garment 300 includes a water resistant lining that prevents the passage of fluids through the body-covering portion 301. Antimicrobial or antibacterial coatings or treatments may be applied to the material forming the garment 300 as well.

As noted above, the garment 300 can be configured for a variety of applications. Accordingly, the garment 300 can be configured in a variety of lengths. In the illustrative embodiment of FIGS. 3-8, the garment 300 is configured with a length that runs from a wearer's shoulder to below their knee. Examples of such a length include between forty-one inches and forty-eight and a half inches. It will be clear to those having the benefit of this disclosure that such a length is illustrative only, as the garment 300 can be configured with other lengths without departing from the spirit and scope of the disclosure. Further, the various sides do not have to be the same length. For example, the front of the garment 300, shown in FIG. 3, can be longer or shorter than the back of the garment 300, shown in FIG. 5.

In one or more embodiments, a first sleeve and a second sleeve extend distally from the body-covering portion 301. In one or more embodiments, the length of the sleeves is about seventeen and a quarter inches. In one or more embodiments, the first sleeve and the second sleeve are configured to receive wearer's arms when the garment 300 is donned.

In the illustrated embodiment of FIGS. 3-8, the first sleeve and second sleeve are each configured as was the sleeve 100 of FIGS. 1-2. As noted above, one or both of the short sleeves can be configured as IV sleeves where an opening 501 created by the overlap of the second convex down contour 206 overlaps the first convex down contour 204. This allows the sleeve 100 to function as an IV sleeve, in that the first convex down contour 204 and the second convex down contour 206 can be separated to provide medical services personnel partial access to a patient's arm through which intravenous medical apparatuses may pass.

A front portion 316 of the garment 300 is configured for placement against the front of the torso. The front portion 316 may have a width of, for example, 53.5 inches or 56 inches. The base of the front portion 316 may have a width of, for example, 63.5 inches or 65 inches. The body-covering portion 301 then wraps around the torso and terminates at an opening 302. The opening 302, in one embodiment, is situated in the center of the front portion 316. Note that the opening 302 is shown on the front portion 316 of the garment 300 for illustration only. The opening 302 could also be located on a side of the garment 300, or in the rear as well.

In the illustrative embodiment of FIGS. 3-8, the opening 302 is configured to run the length of the body-covering portion 301, up the front portion 316 of the garment 300, and terminating at a head opening 303. In one embodiment, the garment 300 is configured with a closing component. The closing component is configured to close the opening 302 once the body-covering portion 301 is wrapped around the torso. In accordance with one or more embodiments of the disclosure, the closing component is adjustable such that a wearer can cause the garment 300 to be one of a plurality of sizes, with the selected size depending upon the configuration of the closing component.

In the illustrative embodiment of FIGS. 3-8, the closing component comprises a plurality of closing elements 304, 305,306,307. The closing elements 304,305,306,307 of FIGS. 3-8 are configured as snaps. A first snap portion is coupled to the left side of the front portion 316, while two complementary snap portions are placed on the right side of the front portion 316. While two complementary snap portions are shown to allow the garment 300 to be adjusted to two sizes in this illustrative embodiment, three, four, five, six, or more remaining snap portions can be used to offer a wider variety of adjustable sizes.

A wearer can adjust the size of the garment 300 by selecting to which of the complementary snap portions the first closing elements 304,305,306,307 should be coupled. For example, when a wearer couples the first closing element 304 to closing element (not shown) under closing element 304, the garment 300 is configured with a first size. When the wearer couples the first closing element 304 to closing element 309, the garment 300 is configured with a second size, with the second size being smaller than the first.

The head opening 303 can be configured with a variety of shapes. In one embodiment, the head opening 303 is configured as a round neck. In the illustrative embodiment of FIGS. 3-8 the head opening 303 is configured as a V-neck. The head opening 303 can be configured in other configurations as well.

In one or more embodiments, the sleeve 100 is coupled to the body-covering portion 301 at a seam 310. In the illustrative embodiment of FIGS. 3-8, the seam 310 intersects the head opening 303 at a first location 311 and a second location 511. The sleeve 100 then extends from the seam 310 to a terminal edge 102 as described above with reference to FIGS. 1-2.

In the illustrative embodiment of FIGS. 3-8, the terminal edge 102 comprises a first shoulder covering length 312. In one or more embodiments, the first shoulder covering length 312 extends distally from the head opening 303 at the first location 311. In one or more embodiments, the terminal edge 102 comprises a second shoulder covering length 512. In one or more embodiments, the second shoulder covering length 512 extends distally from the head opening 303 at the second location 511.

As described above with reference to FIGS. 1-2, a curved length 313 spans and connects the distal ends of the first shoulder covering length 312 and the second shoulder covering length 512. Two convex contours 204,206 then overlap when the sleeve 100 is in the closed configuration By coupling the proximal edge 202 from FIG. 2 to the body-covering portion 301 at seam 310, which extends from the head opening 303 at the first location 311 and the second location 511, the sleeve 100 defines a "Raglan" sleeve. A "Raglan" sleeve is a sleeve that extends fully to the collar, i.e. the edge of the head opening 303, leaving a diagonal seam from underarm to collarbone. The Raglan sleeve is the namesake of Lord Raglan, allegedly the first Baron Raglan. Lord Raglan is known to have worn coats with this sleeve style after losing an arm when fighting in the Battle of Waterloo. While a Raglan sleeve is one type of sleeve suitable for use with garments 300 configured in accordance with embodiments of the disclosure, other types of sleeves can be used as well.

In the illustrative embodiment of FIGS. 3-8, the body-covering portion 301 comprises a Raglan sleeve defining edge 317 that couples to the sleeve 100 at the seam 310. So as to properly connect to the sleeve, in one or more embodiments the Raglan sleeve defining edge 317 comprises a first edge length 314, a second edge length 514, and a third edge length 315. In this illustrative embodiment, the Raglan sleeve defining edge 317 intersects the head opening 303 at the first location 311 and the second location 511. The third edge length 315 then spans the first edge length 314 and the second edge length 514.

To correspond with the proximal edge 202 of the seam, in one or more embodiments the first edge length 314 extends distally from the first location 311 for a length equal to that which the first shoulder covering length 312 extends from the head opening 303 at the first location 311. Similarly, the second edge length 515 extends distally from the second location 511 for a length equal to that which the second shoulder covering length 512 extends from the head opening 303 at the second location 511. The third edge length 315 then spans these termination points so as to encircle the arm of the wearer along the seam 310. This third edge length, when the Raglan sleeve is coupled to the body-covering portion 301, thus becomes an arm encircling length spanning the first shoulder covering length 312 and the second shoulder covering length 512.

As shown in FIGS. 3-8, one or more fasteners are attached to the sleeve 100. In one or more embodiments, at least a first fastener 212 is coupled to the proximal edge 202 of the sleeve 100 within the first shoulder covering length 312. Alternatively, in one or more embodiments the first fastener 212 can be coupled to the body-covering portion 301 at the Raglan sleeve defining edge 317 within the first edge length 314. The first fastener 212 could be coupled to both the sleeve 100 and the body-covering portion 301 along the seam 310 in another embodiment. In one or more embodiments, the first fastener 212 comprises a female socket fastener having its female socket exposed along an interior surface of the sleeve 100.

In this illustrative embodiment, at least a second fastener 107 is coupled to the terminal edge 102 of the sleeve 100 within the second shoulder covering length 512. In this illustrative embodiment, the second fastener 107 is configured as a female socket fastener having its female socket exposed along an interior surface of the sleeve 100.

In the illustrative embodiment of FIGS. 3-8, a third fastener 214 is coupled to the proximal edge 202 of the sleeve 100 within the first shoulder covering length 312. Alternatively, in one or more embodiments the third fastener 214 can be coupled to the body-covering portion 301 at the Raglan sleeve defining edge 317 within the first edge length 314. The third fastener 214 could be coupled to both the sleeve 100 and the body-covering portion 301 along the seam 310 in another embodiment. In one or more embodiments, the third fastener 214 comprises a female socket fastener having its female socket exposed along an interior surface of the sleeve 100.

In this illustrative embodiment, at least a fourth fastener 109 is coupled to the terminal edge 102 of the sleeve 100 within the second shoulder covering length 512. In this illustrative embodiment, the fourth fastener 109 is configured as a female socket fastener having its female socket exposed along an interior surface of the sleeve 100. It should be noted that while two fasteners are shown within the first shoulder covering length 312 and the second shoulder covering length 512, respectively, in this illustrative embodiment, it will be obvious to those of ordinary skill in the art having the benefit of this disclosure that embodiments could include more, or fewer, fasteners as well.

Figure 8:
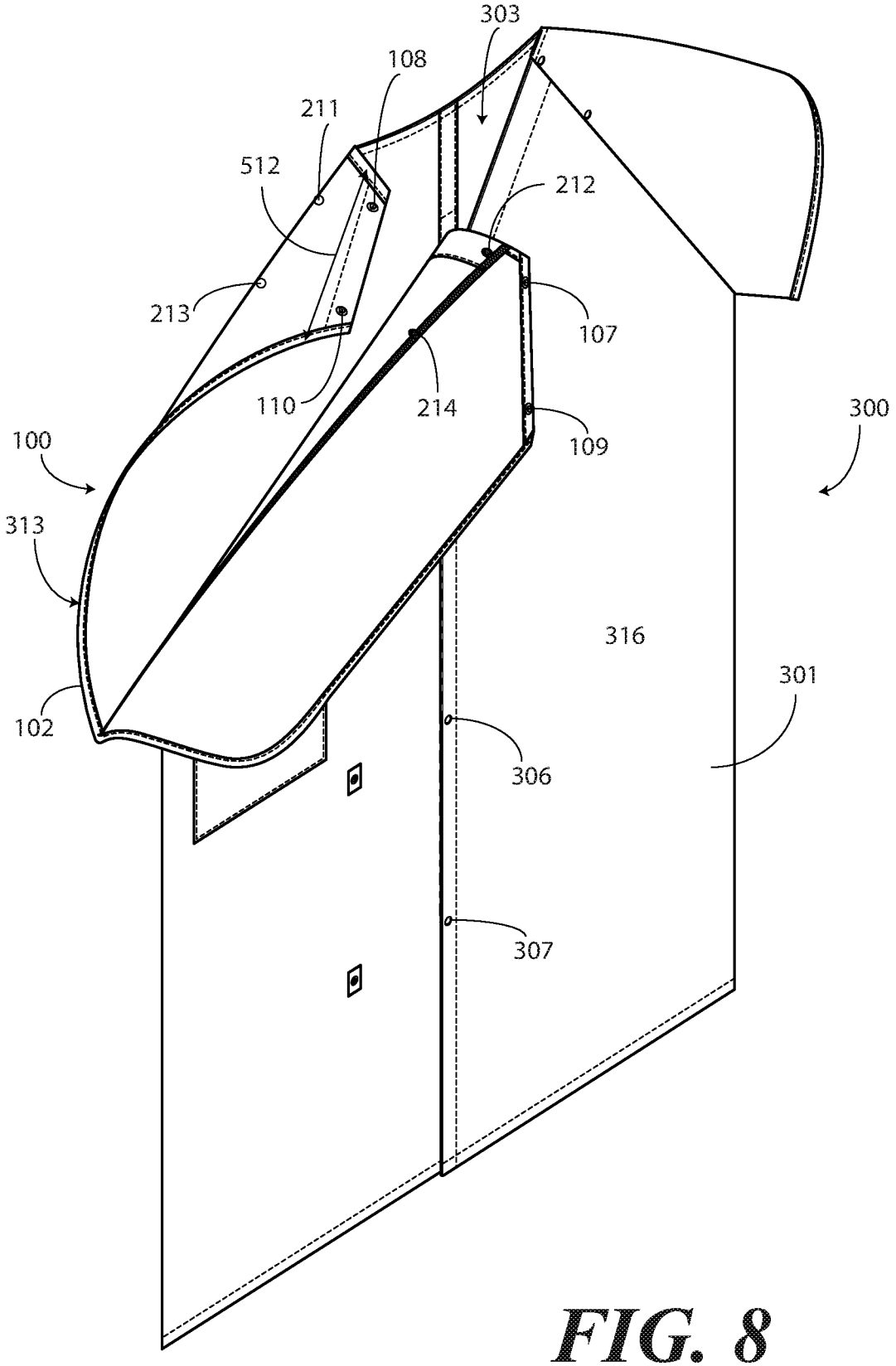
FIG. 8 illustrates a perspective view of one explanatory gown having a selectively openable sleeve in an open position in accordance with one or more embodiments of the disclosure.

As best shown in FIG. 8, where the sleeve 100 is fully opened, in one or more embodiments additional fasteners are included. In this illustrative embodiment, at least a fifth fastener 211 is coupled to the proximal edge 202 of the sleeve 100 within the second shoulder covering length 512. Alternatively, in one or more embodiments the fifth fastener 211 can be coupled to the body-covering portion 301 at the Raglan sleeve defining edge 317 within the second edge length 514. The fifth fastener 211 could be coupled to both the sleeve 100 and the body-covering portion 301 along the seam 310 in another embodiment. In one or more embodiments, the fifth fastener 211 comprises a male post fastener having its male post exposed along an exterior surface of the sleeve 100.

In this illustrative embodiment, at least a sixth fastener 108 is coupled to the terminal edge 102 of the sleeve 100 within the first shoulder covering length 312. In this illustrative embodiment, the sixth fastener 108 is configured as a male post exposed along an exterior surface of the sleeve 100.

In the illustrative embodiment of FIGS. 3-8, a seventh fastener 213 is coupled to the proximal edge 202 of the sleeve 100 within the second shoulder covering length 512. Alternatively, in one or more embodiments the seventh fastener 213 can be coupled to the body-covering portion 301 at the Raglan sleeve defining edge 317 within the second edge length 514. The seventh fastener 213 could be coupled to both the sleeve 100 and the body-covering portion 301 along the seam 310 in another embodiment. In one or more embodiments, the seventh fastener 213 comprises a male post exposed along an exterior surface of the sleeve 100.

In this illustrative embodiment, at least an eighth fastener 110 is coupled to the terminal edge 102 of the sleeve 100 within the first shoulder covering length 312. In this illustrative embodiment, the eighth fastener 110 is configured as a male post exposed along an exterior surface of the sleeve 100.

As shown in FIG. 8, by uncoupling the fasteners, e.g., when fastener 212 is uncoupled from fastener 108, and fastener 214 is uncoupled from fastener 110, and fastener 107 is further uncoupled from fastener 211, with fastener 109 uncoupled from fastener 213, the sleeve opens, allowing the head opening 303 to separate between the first location 311 and the second location 513. This provides full access to the arm of a wearer by simply unsnapping two pairs of snaps.

Figure 7:
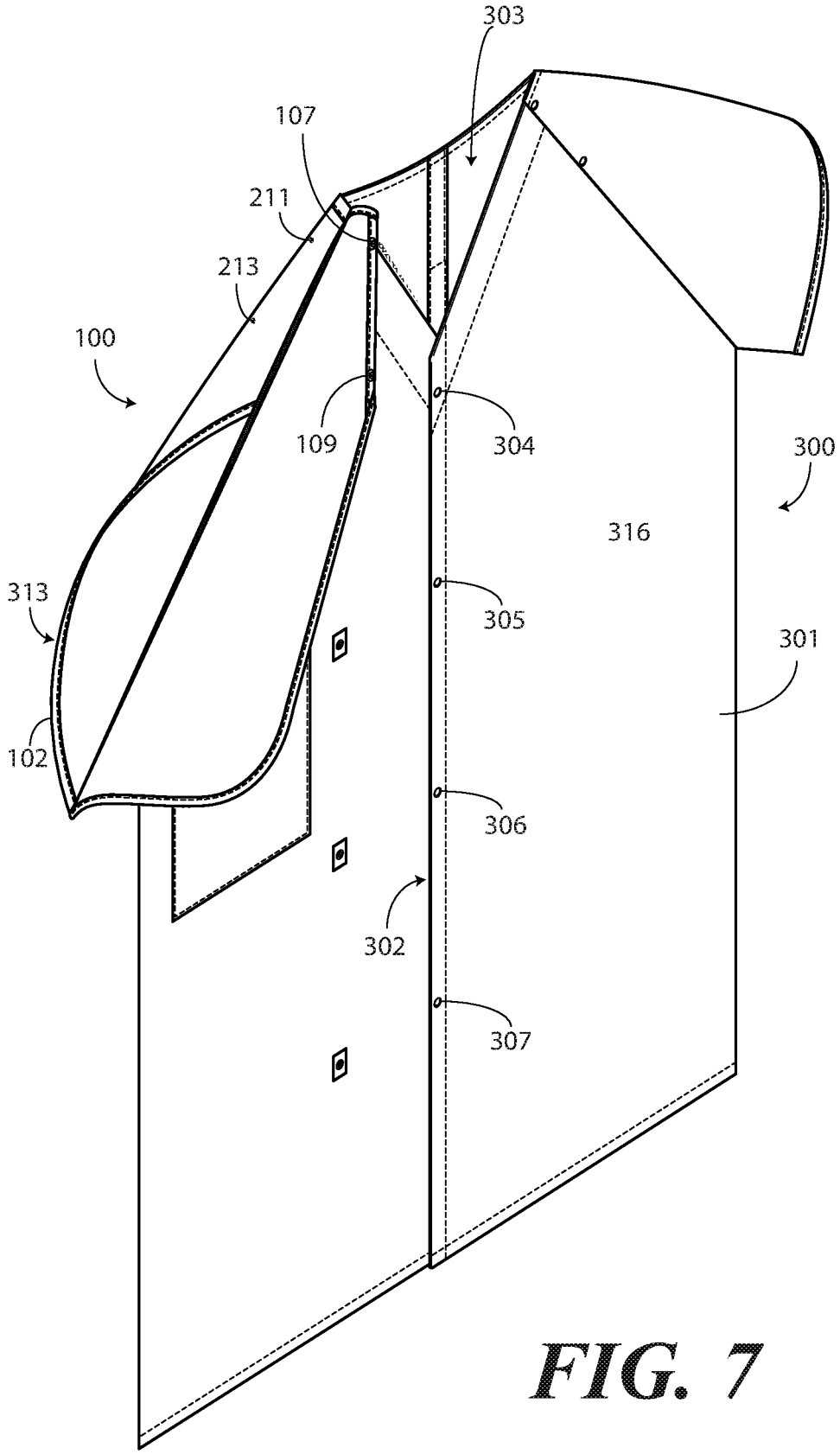
FIG. 7 illustrates a perspective view of one explanatory gown having a selectively openable sleeve in a partially open position in accordance with one or more embodiments of the disclosure.

By contrast, when fastener 212 is coupled to fastener 108 (as shown in FIG. 7), and fastener 214 is coupled to fastener 110 (also shown in FIG. 7), and fastener 107 is further coupled to fastener 211 (shown in FIGS. 3-6), with fastener 109 coupled to fastener 213 (also shown in FIGS. 3-6), portions of the sleeve overlap, thereby defining an overlapping, openable Raglan sleeve. In this illustrative embodiment, the head insertion edges (220,221) of the sleeve 100 overlap and span the first location 311 and the second location 513 when the sleeve 100 is in the closed configuration, e.g., when the fastener 107 is coupled to fastener 211, and so forth.

Figure 9:
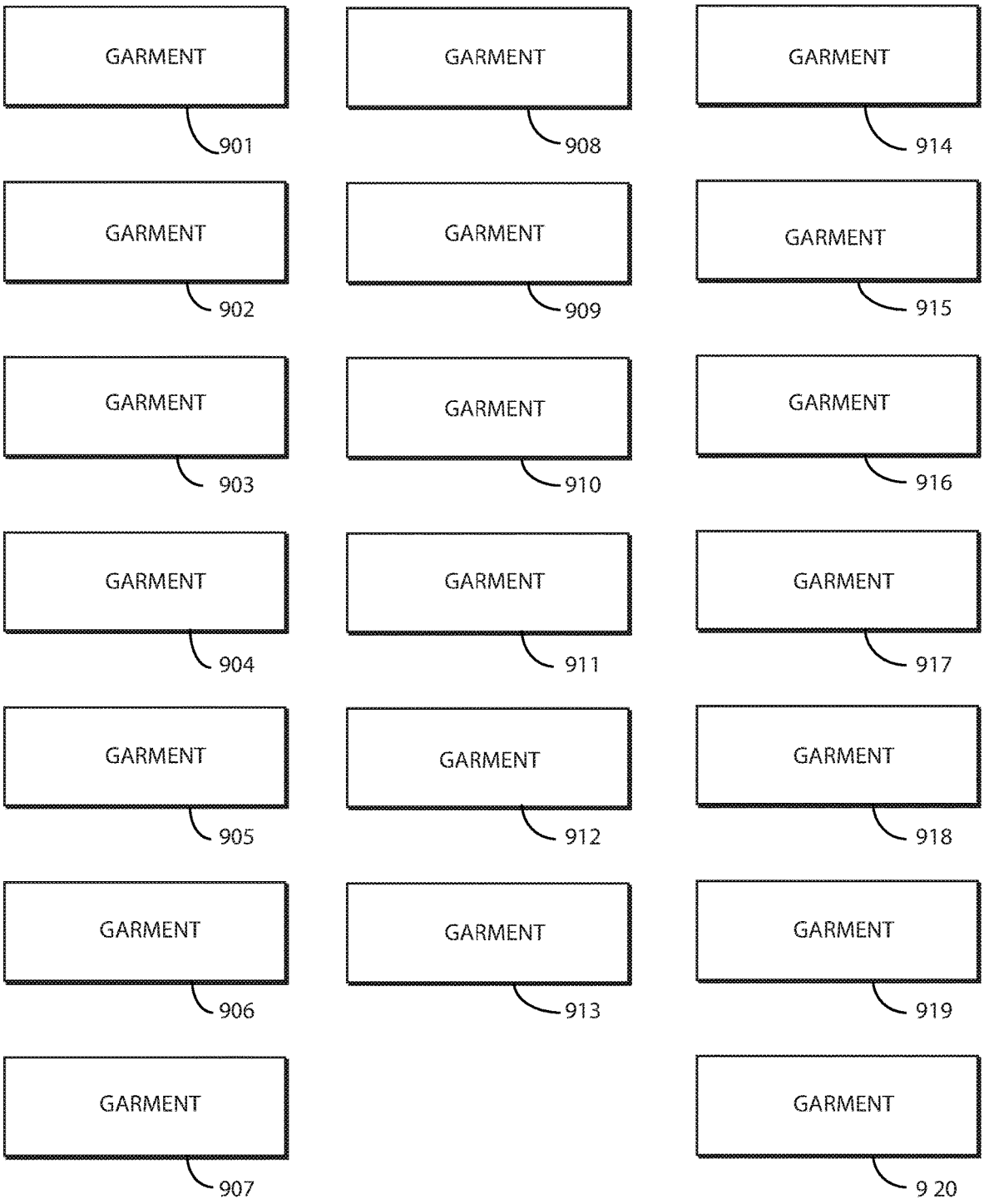
FIG. 9 illustrates various embodiments of the disclosure.

Turning now to FIG. 9, illustrated therein are various embodiments of the disclosure. At 901, a garment comprises a body-covering portion. At 901, the garment comprises a sleeve attached to the body-covering portion at a seam. At 901, the sleeve extends to a terminal edge defining a first linear portion, a second linear portion, and a curved portion spanning the first linear portion and the second linear portion.

At 901, at least a first fastener is coupled to the first linear portion on an interior side of the terminal edge. At 901, at least a second fastener is coupled to the second linear portion on an exterior side of the terminal edge. At 901, at least a third fastener is coupled to the seam on an exterior side of the seam. At 901, at least a fourth fastener coupled to the seam on an interior side of the seam.

At 902, the first fastener of 901 is coupled to the third fastener. At 903, the second fastener of 902 is coupled to the fourth fastener. At 904, one or more of the at least a first fastener, the at least a second fastener, the at least a third fastener, or the at least a fourth fastener of 903 comprises a snap.

At 905, the garment of 903 further comprises at least a fifth fastener coupled to the first linear portion on the interior side of the terminal edge. At 905, the garment of 903 comprises at least a sixth fastener coupled to the second linear portion on the exterior side of the terminal edge. At 905, the garment of 903 comprises at least a seventh fastener coupled to the seam on the exterior side of the seam. At 905, the garment of 903 comprises at least an eighth fastener coupled to the seam on the interior side of the seam.

At 906, the fifth fastener of 905 is coupled to the seventh fastener. At 907, the sixth fastener of 906 is coupled to the eighth fastener. At 908, the sleeve of 901 comprises an overlapping Raglan sleeve.

At 909, a garment comprises a body-covering portion defining a head opening. At 909, the garment comprises a sleeve coupled to the body-covering portion at a seam. At 909, the sleeve extends to a terminal edge comprising a first shoulder covering length extending from the head opening at a first location and a second shoulder covering length extending from the head opening at a second location.

At 909, the sleeve comprises a first fastener coupled to the terminal edge along the first shoulder covering length and a second fastener coupled to the terminal edge along the second shoulder covering length. At 909, the sleeve comprises a third fastener coupled to the seam on an interior side of the garment and a fourth fastener coupled to the seam on an exterior side of the garment.

At 910, the first fastener of 909 is coupled to the third fastener. At 910, the second fastener of 909 is coupled to the fourth fastener. At 909, the sleeve defines an overlapping, openable Raglan sleeve. At 911, when the first fastener is uncoupled from the third fastener and the second fastener is uncoupled from the fourth fastener, the head opening separates between the first location and the second location.

At 912, the garment of 909 further comprises a fifth fastener coupled to the terminal edge along the first shoulder covering length. At 912, the garment of 909 further comprises a sixth fastener coupled to the terminal edge along the second shoulder covering length. At 912, the garment of 909 further comprises a seventh fastener coupled to the seam on the interior side of the garment. At 912, the garment of 909 further comprises an eighth fastener coupled to the seam on the exterior side of the garment.

At 913, the terminal edge of 909 further comprises a curved length spanning the first shoulder covering length and the second shoulder covering length. At 914, the curved length of 913 comprises two convex contours separated by a substantially straight length.

At 915, the two convex contours of 914 overlap when the first fastener is coupled to the third fastener and the second fastener is coupled to the fourth fastener. At 916, the terminal edge of 909 comprises a color-coded hem.

At 917, a garment comprises a body-covering portion defining a head opening. At 917, the garment comprises at least one Raglan sleeve defining edge intersecting the head opening at a first location and a second location.

At 917, the Raglan sleeve defining edge comprises a first edge length extending distally from the first location. At 917, the Raglan sleeve defining edge comprises a second edge length extending distally from the second location. At 917, the Raglan sleeve defining edge comprises a third edge length spanning the first edge length and the second edge length. At 917, at least one sleeve layer comprises a first edge coupled to the Raglan sleeve defining edge at a seam.

At 917, the at least one sleeve layer extends distally from the seam to a terminal edge. At 917, the terminal edge defines a first shoulder covering length extending distally from the head opening. At 917, the terminal edge defines a second shoulder covering length extending distally from the head opening. At 917, the terminal edge defines an arm encircling length spanning the first shoulder covering length and the second shoulder covering length.

At 917, at least a first fastener is coupled to the seam along the first edge length. At 917, at least a second fastener is coupled to the seam along the second edge length. At 917, at least a third fastener is coupled to the terminal edge along the first shoulder covering length. At 917, at least a fourth fastener is coupled to the terminal edge along the second shoulder covering length.

At 918, the at least one sleeve layer of 917 comprises a first sleeve layer portion and a second sleeve layer portion. At 918, the first sleeve layer portion and the second sleeve layer portion are coupled together at another seam oriented orthogonally with the arm encircling length.

At 919, the at least one sleeve layer of 917 defines a head insertion edge spanning the first location and the second location when the at least a first fastener is coupled to the at least a third fastener. At 920, the first fastener and the second fastener of 917 comprise male snap portions, while the third fastener and the fourth fastener comprising female snap portions.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A garment, comprising:

a body-covering portion;

a sleeve attached to the body-covering portion at a seam and extending to a terminal edge defining a first linear portion, a second linear portion, and a curved portion spanning the first linear portion and the second linear portion;

at least a first fastener coupled to the first linear portion on an interior side of the terminal edge;

at least a second fastener coupled to the second linear portion on an exterior side of the terminal edge;

at least a third fastener coupled to the seam on an exterior side of the seam; and at least a fourth fastener coupled to the seam on an interior side of the seam.

2. The garment of claim 1, wherein the at least a first fastener is coupled to the at least a third fastener.

3. The garment of claim 2, wherein the at least a second fastener is coupled to the at least a fourth fastener.

4. The garment of claim 3, wherein one or more of the at least a first fastener, the at least a second fastener, the at least a third fastener, or the at least a fourth fastener comprises a snap.

5. The garment of claim 3, further comprising:

at least a fifth fastener coupled to the first linear portion on the interior side of the terminal edge;

at least a sixth fastener coupled to the second linear portion on the exterior side of the terminal edge;

at least a seventh fastener coupled to the seam on the exterior side of the seam; and at least an eighth fastener coupled to the seam on the interior side of the seam.

6. The garment of claim 5, wherein the at least a fifth fastener is coupled to the at least a seventh fastener.

7. The garment of claim 6, wherein the at least a sixth fastener is coupled to the at least an eighth fastener.

8. The garment of claim 1, the sleeve defining an overlapping Raglan sleeve.

* * * * *